US012253097B2

(12) United States Patent
Stempfle

(10) Patent No.: US 12,253,097 B2
(45) Date of Patent: Mar. 18, 2025

(54) IMMERSION PUMP

(71) Applicant: HYSYPRO AG, Wolfenschiessen (CH)

(72) Inventor: Philipp Stempfle, Neuburg (DE)

(73) Assignee: HYSYPRO AG, Wolfenschiessen (CH)

( * ) Notice: Subject to any disclaimer, the term of this patent is extended or adjusted under 35 U.S.C. 154(b) by 0 days.

(21) Appl. No.: 18/658,467

(22) Filed: May 8, 2024

(65) Prior Publication Data

US 2024/0376906 A1 Nov. 14, 2024

(51) Int. Cl.

| | |
|---|---|
| ***F04D 13/08*** | (2006.01) |
| ***F04D 29/42*** | (2006.01) |
| ***F04D 29/44*** | (2006.01) |

(52) U.S. Cl.

CPC ..... *F04D 29/426* (2013.01); *F04D 29/4293* (2013.01); *F04D 29/445* (2013.01)

(58) Field of Classification Search

CPC . F04D 29/428; F04D 1/14; F04D 7/02; F04D 13/086; F04D 7/04; F04D 13/08; F04D 29/42; F04D 29/60

See application file for complete search history.

(56) References Cited

U.S. PATENT DOCUMENTS 2,625,110 A * 1/1953 Haentjens ..... F04D 1/006 415/206
4,747,757 A 5/1988 Haentjens
4,874,575 A * 10/1989 Dunn ..... F04D 7/08 415/206
5,141,390 A * 8/1992 Haentjens ..... F04D 15/0022 415/206
2012/0224982 A1 9/2012 Nuhn
2017/0030371 A1 2/2017 Wilds et al.

FOREIGN PATENT DOCUMENTS

| | | | |
|---|---|---|---|
| CN | 101408200 | A | 4/2009 |
| CN | 207526705 | U | 6/2018 |
| CN | 108626172 | A | 10/2018 |
| CN | 110360154 | A | 10/2019 |

(Continued)

OTHER PUBLICATIONS

EPO, Form EPO Form 1503 03.82, Communication & Ext. EP Search Report for European Patent Appin. EP 24174242, Sep. 6, 2024 (3 pp.) together with EPO Form 1703 01.91TRI (7 pp.).

*Primary Examiner* — Eldon T Brockman
(74) *Attorney, Agent, or Firm* — Pauley Erickson & Swanson

(57) ABSTRACT

An immersion pump (1) for conveying a fluid, preferably industrial or waste water, includes a drive unit (2) which extends along a rotational axis (x) and which is connected to a pump unit (3), wherein the pump unit (3) includes a pump casing (3.1) and a pump impeller (3.2), wherein the pump casing (3.1) includes a pump chamber (3.1.1) in which the pump impeller (3.2) is arranged rotatably about the rotational axis (x) and at least one inlet opening (3.1.2) for the fluid includes a pump chamber (3.1.1) in which the pump impeller (3.2) is arranged rotatably about the rotational axis (x) and includes at least one inlet opening (3.1.2) for the fluid and an outlet chamber (3.1.3) which is fluidically connected to the pump chamber (3.1.1) and has at least two outlet openings (3.1.4) through which the fluid can be pumped out.

15 Claims, 4 Drawing Sheets

(56) References Cited

FOREIGN PATENT DOCUMENTS

| | | | | | |
|---|---|---|---|---|---|
| DE | 33 16 927 | A1 | | 11/1984 | |
| DE | 202020104824 | U1 | * | 1/2022 | ..... F04D 1/06 |
| EP | 2960375 | A1 | * | 12/2015 | ..... E02F 3/9231 |
| EP | 3 957 862 | A1 | | 2/2022 | |
| WO | WO 03/014575 | A1 | | 2/2003 | |

* cited by examiner

IMMERSION PUMP

CROSS-REFERENCE TO RELATED APPLICATIONS

Swiss Patent Application Nos. CH 000493/2023, filed 9 May 2023, the priority document, corresponding to this invention, to which a foreign priority benefit is claimed under Title 35, United States Code, Section 119, and its entire teachings are incorporated, by reference, into this specification.

FIELD OF THE DISCLOSURE

The present disclosure relates to an immersion pump with two outlet openings to increase the flow rate.

BACKGROUND OF THE DISCLOSURE

The following immersion pumps, among others, are known from the state of the art.

U.S. Pat. No. 4,747,757A, published May 31, 1988 on behalf of Haentjens, relates to a bottom inlet immersion mixer pump comprising a double volute centrifugal pump feeding a pair of vertical channels which in turn feed an annular chamber extending around the motor stator for cooling. The annular chamber has partial partitions between the chamber inlets and the chamber outlets which feed outlet nozzles to ensure a certain fluid level in the chamber.

EP3957862A1, published on 23 Feb. 2022 in the name of Brinkman Pumpen, relates to a liquid pump with a housing forming a suction opening, a pump chamber, a discharge nozzle and a motor chamber, a shaft rotatably mounted in the housing, on which an impeller is arranged within the pump chamber and on which a rotor of an electric motor is arranged in a section lying outside the pumped medium, which rotor is surrounded by a stator arranged in the motor chamber, and with a cooling jacket surrounding the motor chamber, which cooling jacket is in fluid connection with the pump chamber on the one hand and with the outlet connection piece on the other hand, wherein a pressure line, which connects the pump chamber to the cooling jacket, opens into the cooling jacket in a first circumferential position and the outlet connection piece is connected to the cooling jacket in a second circumferential position, characterized in that the housing has a circumferential fastening flange which is designed to mount the pump on a collecting basin for the liquid to be pumped, and in that the fastening flange is arranged at the level of the end of the cooling jacket facing the pump chamber.

EP2960375A1, published on 30 Dec. 2015 on behalf of Dragflow, relates to a immersion pump comprising a first motor provided with a first shaft, a pump body having an impeller attached to the first shaft of the first motor for pumping a process fluid from a suction opening to an outlet opening of the pump body, a support housing attached to the pump body and provided with an inlet opening at its lower end, a dispersion head attached to the lower end of the support housing and a dispersion head attached to the lower end of the support housing, attached to the pump body and d provided with an inlet opening at its lower end, a dispersion head disposed at the lower end of the support housing and drivable to remove detrital material, a first filter element disposed inside the support housing, and an agitating element disposed inside the support housing between the dispersion head and the first filter element and attached to the first outlet chute to remove the bodies of detrital material from the first filter element.

SUMMARY OF THE DISCLOSURE

Immersion pumps, which are also referred to as sump pumps or submersible pumps, are well known. They are typically used in civil protection, for fire departments or in the field of water supply and wastewater disposal as portable or stationary pumps. Centrifugal pumps are usually used here, which are immersed in the liquid to be pumped. Preferably, drive units are used that work by means of hydraulics, as the immersion pump is then lighter, but also requires a corresponding hydraulic pump.

Depending on the application and the required liter capacity, pumps with various hose diameters and corresponding pump sizes are used. As with pipes, the dimensions of hoses in the industrial sector are generally based on the inside diameter and given in inches. The decisive factor here is the nominal diameter, which is usually referred to as DN (French: diamètre nomina) and indicates the inner diameter of the hose in inches. Common nominal diameters range between ⅛ inch and 10 inches, i.e. between 3.18 mm and 254 mm. Theoretically, this results in a great flexibility of hose diameters and, with appropriately sized pumps, an enormous range of possible liter capacity.

In practice, however, structural and economic conditions limit the degree of freedom in the selection of hose and pump. For example, the possible bending radius of the hose is a limiting factor in very tight installation spaces. In particular, reinforced and inherently stable hoses that are used for applications with very long hose lengths, typically several hundred or even thousands of meters, can only be bent to a very limited extent. Sewers and manholes in the wastewater sector, for example, are also standardized and typically limited to a diameter of between 400 mm and 500 mm. Very large pumps, which are required for large hose diameters from a DN of 6 inches upwards in order to be able to provide the corresponding liter capacity with the given cross-sections, are often too large for such installation spaces. Hose sizes with a DN from 5 inches upwards are also reluctantly used, as they are significantly more expensive to purchase than the more readily available hose sizes with a DN of 4 or 5 inches or less. In addition, it is difficult to lay such hoses with a DN from 5 inches upwards by hand, but is typically only possible using construction equipment and is therefore also not desirable.

The problem is therefore that, on the one hand, the largest possible output in liters is desired in all areas of applications. As this depends significantly on the pipe cross-section and the flow velocity for incompressible fluids, the largest possible cross-sectional area and therefore a hose with the largest possible DN value would be desirable. On the other hand, for the reasons mentioned above, hoses and pumps should be as small as possible.

One objective of the present disclosure can be seen in increasing the throughput and the liter capacity of the immersion pump without having to increase the size of the immersion pump or the hose diameter.

An immersion pump according to the present disclosure for conveying a fluid, for example industrial or waste water, comprises a drive unit and a pump unit. The drive unit typically extends along a rotational axis, which is connected to a pump unit. Typically, the drive unit is directly connected to the pump unit, for example flange-mounted. The drive unit is preferably arranged outside the pump casing. In this case, the drive unit can be operatively connected to the pump impeller via a shaft, which is arranged inside the pump casing. This enables a modular design of the immersion pump. This means that different drive units with different drive powers can be connected to one casing without the need for a larger or smaller casing. The drive unit can also be replaced quickly and easily without having to dismantle the entire pump. The drive unit can, for example, comprise an electric motor, which can optionally be shielded and sealed against environmental influences by a motor housing. Alternatively, the drive unit can be hydraulically driven. Preferably, hydraulic drive units are used, as these are lighter and smaller in comparison to an electric motor for the same sized immersion pump.

The pump unit comprises a pump casing and a pump impeller. The pump impeller is arranged to rotate within the pump casing and draws in the fluid through at least one inlet opening (suction side) and discharges it again at increased pressure (pressure side). Conventional pump casings usually have an essentially circular cylindrical cross-section to which an inlet flange and an outlet flange are attached. In contrast to this, the pump casing of the immersion pump according to the disclosure typically has a pump chamber in which the pump impeller is arranged to rotate about the rotational axis and also has a separate outlet chamber formed to the pump chamber. At the transition, the pump chamber merges into the outlet chamber.

The pump chamber has at least one inlet opening for the fluid. Typically, the pump chamber is limited by an upper level, typically the upper pump casing wall, which points towards the drive unit, and is limited on the opposite side by a lower level, typically the lower pump casing wall, which points away from the drive unit. The clearance height of the pump chamber corresponds to the distance between the upper level, the upper pump casing wall and the lower level, lower pump casing wall. The typically essentially cylindrical pump impeller is arranged in the pump chamber, with the base and top surfaces of the pump impeller arranged parallel to the upper and lower levels of the pump chamber. The inlet opening may be arranged on the side of the pump casing, the lower pump casing wall, facing away from the drive unit, preferably collinear to the rotational axis. The inlet opening is typically arranged in an inlet flange of the pump casing. The inlet flange can be flow-optimized, preferably funnel-shaped.

The two outlet openings are preferably arranged in the outlet area of the outlet chamber facing away from the pump chamber. A compact design of the immersion pump is achieved if the two outlet openings are essentially arranged in the upper level of the pump chamber or are only offset insignificantly upwards or downwards towards the lower level of the pump chamber. Good pumping behavior combined with a compact design is achieved if the distance between the two outlet openings and the upper level of the pump chamber does not exceed a ratio of 0.75 in relation to the clearance height of the pump chamber.

$$\text{ratio} = \frac{\text{distance between outlet openings and upper level of pump chamber}}{\text{clearance height of pump chamber}}$$

Particularly good results are achieved if the ratio of the distance between the two outlet openings and the upper level of the pump chamber is 0.5 in relation to the clearance height of the pump chamber. This leads to a compact design of the casing and consequently to a compact design of the entire immersion pump.

As coarse impurities occur in the fluid to be pumped, particularly in wastewater disposal, the free passage of the immersion pump is typically generously dimensioned. In pump technology, the free passage refers to a ball passage. This describes the maximum diameter of solids, simulated in the form of balls, which can pass through the pump impeller or the pump chamber. In order to maximize the free passage, the pump chamber is therefore typically generously dimensioned in a radial direction circumferential with respect to the pump impeller. The ratio of the diameter of the pump chamber to the diameter of the pump impeller is typically 3:1, preferably 2:1.

The pump casing typically has a casing wall that encircles the pump impeller and can be curved in the circumferential direction of the pump impeller. In order to achieve a flow within the pump chamber with as little turbulence as possible, the geometry of the pump casing is typically selected in such a way that both, bottlenecks are largely excluded and the flow does not meet any vertical surfaces in the area of transitions. Good flow properties are achieved if the pump casing has rounded transitions, rather than sharp edges and transitions in the area of both the pump chamber and the outlet chamber. For example, in the transition between the outlet chamber and the two outlet openings, the ratio between the transition radius and the clearance height of the pump chamber is preferably not less than 0.1.

$$\text{ratio} = \frac{\text{transition radius between outlet chamber and outlet openings}}{\text{clearance height of pump chamber}}$$

Good flow conditions can be achieved with a ratio between 0.1 and 0.25. Preferably, the pump casing is designed as a one-piece casing, optionally as a cast casing made of a metal or plastic. A one-piece casing avoids additional separation points, which could lead to leaks and would make additional seals necessary.

While the diameter of the pump chamber can be increased in relation to the diameter of the pump impeller if the power loss is still tolerable, an increase in the clearance height between the upper level and the lower level of the pump chamber usually reduces the pumping power significantly. Therefore, when dimensioning the pumps, an attempt is made to keep the clearance height of the pump chamber in relation to the height of the pump impeller as low as possible. In conventional designs, however, this leads to problems with the discharge of the pumped fluid on the outlet side.

In known immersion pumps, the fluid is discharged from the pump chamber via a stub that has a circular cylindrical cross-section. However, this cross-section is limited to a diameter that corresponds to the clearance height of the casing. This transition between the pump chamber and outlet typically limits the liter capacity of the pump to be pumped, as the functional cross-section of a circular cylindrical stub is significantly smaller than the functional cross-sectional area of the pump chamber. In conventional pump casings, the functional cross-section at the transition is therefore usually the smallest cross-section of the pump casing, which limits the flow as a bottleneck.

In contrast to this, the pump casing according to the disclosure comprises, in addition to the pump chamber, an outlet chamber, which is fluidically connected to the pump chamber. The outlet chamber can have two outlet openings through which the fluid can be pumped out. A flow-optimized casing can be obtained with the two outlet openings being arranged next to each other. Preferably, the two outlet openings are arranged adjacent to each other on the outlet chamber. The two outlet openings can be arranged in such a way that their central axes are parallel to the rotational axis of the drive unit. Such an arrangement enables a flow-optimized routing of the fluid from the pump chamber, through the outlet chamber to the two outlet openings and into the hoses connected to them during operation. The two outlet openings make it possible to achieve more liter capacity using two commercially available hoses without having to resort to installing hoses with larger diameters, which are expensive and difficult to install. The two outlet openings result in a doubling of the liter capacity compared to known immersion pumps while largely retaining the dimensions of the pump casing. As a result, common installation spaces, such as sewer and shaft diameters, can be served.

For applications with long hose lengths, the siphon effect, which is increased by the second connection and thus an independent second hose during operation while maintaining the existing hose diameters, is particularly important for increasing the pumping capacity. Two outlet openings thus facilitate handling when handling the hoses and minimize the costs for laying them, as these increase exponentially with increasing hose diameters.

With hoses with a DN of 2 inches, for example, an immersion pump with a drive power of 21 kW, for example, can achieve delivery heads of over 30 m while simultaneously doubling the delivery volume compared to conventional immersion pumps with only one outlet opening and no outlet chamber. Instead of 50 cubic meters per hour, up to 100 cubic meters per hour are possible. The motor output can typically be continuously adjusted via the motor speed. If, for example, the user were to operate a 21 KW motor with a 2 inch hose at 100% speed, the resulting back pressure would lead to increased energy consumption, increased wear and possibly even motor failure due to overload.

The outlet chamber can have a first functional cross-sectional area on the inlet side at the transition to the pump chamber and a second functional cross-sectional area on the outlet side, which is formed by the two outlet openings. In order to avoid a reduction in the cross-sectional area between the transition between the pump chamber and the outlet chamber and thus a reduction in the liter capacity of the entire pump, the outlet chamber is flow-optimized. Between the inlet side of the outlet chamber and the outlet side of the outlet chamber, there is both an expansion of the flow channel and a corresponding reduction.

The target cross-section is decisive for the dimensioning of the outlet chamber. The target cross-section is specified by the standardized hoses and their adapters. The target cross-section is typically the functional cross-section of the outlet point, hence the functional cross-sectional area of the outlet openings. The outlet chamber is designed in such a way that the cross-sectional area changes over the entire flow channel between the first functional cross-sectional area and the second functional cross-sectional area, therefore over the entire length of the flow channel, but the functional cross-sectional area constantly corresponds to at least that of the target cross-section and does not fall below the target cross-section. The cross-sectional area of the outlet chamber between the first functional cross-sectional area and the second functional cross-sectional area can be at least as large or larger than the second functional cross-sectional area. The same typically also applies in the transition between the pump chamber and the outlet chamber.

The first functional cross-sectional area is typically equal to the functional cross-sectional area of the pump chamber in the area of the rotational axis. The cross-sectional area of the pump chamber results from an imaginary section of the pump casing along the rotational axis, whereby the sectional area is selected parallel to the transition between the pump chamber and the outlet chamber. The cross-section of the transition between the pump chamber and outlet chamber typically extends over the entire clearance height of the pump casing and over the entire width of the pump casing.

The outlet chamber can have an essentially oval cross-section on the inlet side, preferably at the transition between the pump chamber and the outlet chamber, and merge into two stubs on the outlet side. Each of the stubs typically merges into one of the two outlet openings. In order to evenly distribute the fluid pumped by the pump impeller between the two stubs in the outlet chamber, a protrusion can be arranged in the outlet chamber, preferably between the two stubs. The protrusion can serve as a guide element, which distributes the fluid drawn in by the pump impeller between the two stubs and is preferably V-shaped. The shape of the stubs is typically adapted from an oval inlet on the inlet side to a circular outlet on the outlet side in a flow-optimized manner via inclined surfaces.

The outlet chamber can be designed in such a way that the fluid between the pump chamber and the two outlet openings is essentially deflected by 90°, preferably from the horizontal to the vertical direction. The two outlet openings can be arranged parallel to each other and/or parallel to the rotational axis. The pump flow is typically deflected from the horizontal to the vertical direction via a bend. The cross-sectional area of the outlet is maintained over the entire area of the bend in order to avoid constriction. In order to achieve a continuous cross-sectional area between the pump chamber and the two outlet openings, the pump chamber can have a U-shaped cross-section in a top view along the rotational axis. The outlet chamber typically has an oval cross-section when viewed from the top. In order to avoid a narrowing in the area of the second functional cross-sectional area and thus a narrowing due to the two preferably circular outlet openings, their diameter is typically larger than the clearance height of the pump chamber.

By using adapters that can be connected to the outlet openings, the user can display various characteristic curves with just a single immersion pump by selecting different adapters. In addition, the characteristic curves can also be displayed twice due to the two outlet openings. The user can therefore choose to operate the immersion pump with just one outlet, for example 4 inches, or with two outlets, for example 2 times 2 inches, which would correspond to the use of two immersion pumps. In conjunction with an adjustable speed of the drive unit, this is both energy-efficient and without the risk of overloading the drive unit.

In addition to the choice of characteristic curves, the user often has the problem of not having the optimum hose diameter. For example, if the user only has hoses with a DN of 3 inches, he can connect two of them and thus achieve a pumping capacity that would otherwise only be possible using a pump for hoses with a DN of 4 inches. Of course, the user can also choose combinations of different adapters, for example one 2 inch and one 3 inch adapter. In order to be able to change the adapters quickly, the two stubs can each have an outlet flange to which the pipe adapters can be effectively connected.

The optimized flow pattern in conjunction with appropriate adapters enables the user to cover a wide range of applications with a single immersion pump. If an operator wants to achieve the same range of applications, he usually has to use a large number of different conventional immersion pumps. Flow-optimized adapters can be fitted to the respective outlets. These adapters can reduce the outlet, for example from 5 to 3 inches, via an incline. In principle, any adapter can be manufactured. In principle, an outlet opening can also be closed. In addition to adapters that reduce the outlet of the immersion pump, for example from 5 to 4 inches, adapters that increase the outlet, for example from 5 to 6 inches, can also be used. If required, the dual pump can also be used as a mono pump by closing one of the two outlet openings. With a given motor power and therefore energy input, it can be used either for high volume at low delivery head or for low volume at high delivery head.

BRIEF DESCRIPTION OF THE DRAWINGS

Aspects of the disclosure are explained in more detail with reference to the embodiments shown in the following figures and the associated description.

DESCRIPTION OF THE EMBODIMENTS

Figure 1:
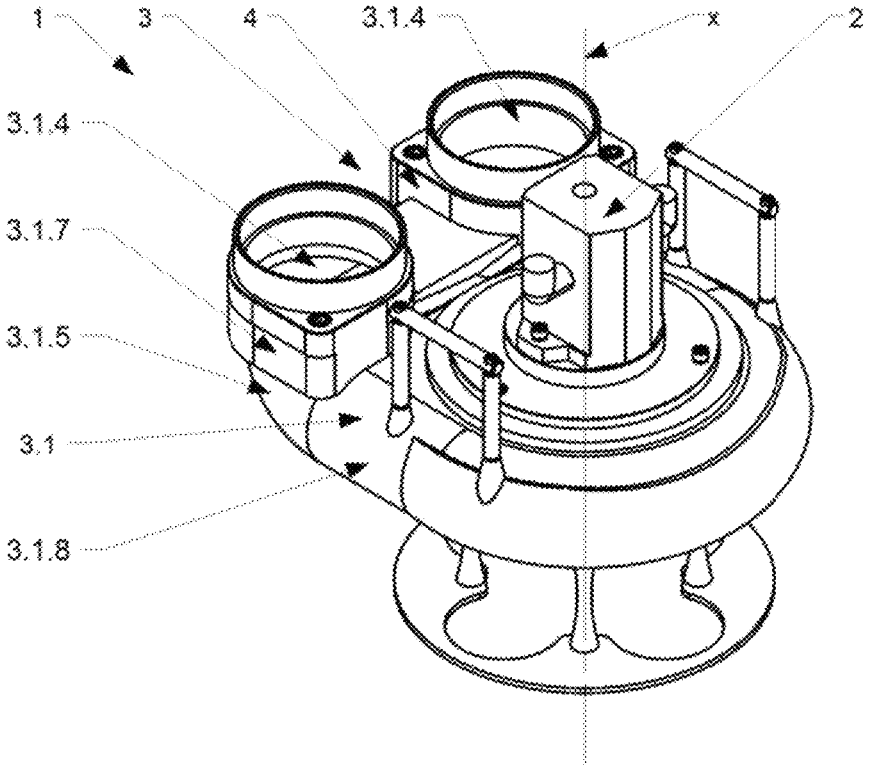
FIG. 1 shows a perspective view from the top onto a first embodiment of the immersion pump.

FIG. 1 shows a perspective view from diagonally above of a first embodiment of the immersion pump 1. The immersion pump 1 shown for conveying a fluid, for example industrial or waste water, comprises a drive unit 2 and a pump unit 3. The drive unit 2 extends along a rotational axis x which is connected to a pump unit 3. In the embodiment shown, the drive unit 2 is directly connected to the pump unit 3, specifically flange-mounted. In the embodiment shown, the drive is hydraulic, whereby the drive unit 2 can also be shielded and sealed against environmental influences by a housing.

Figure 2:
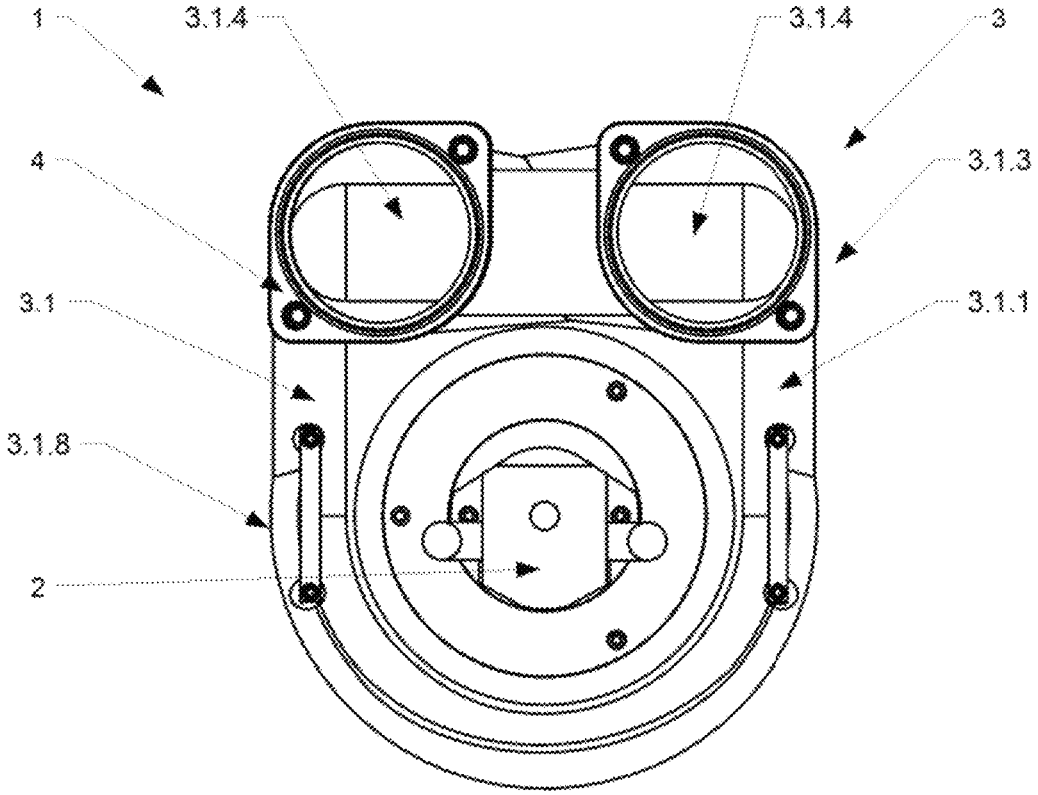
FIG. 2 shows a top view onto the first embodiment of the immersion pump according to FIG. 1.

FIG. 2 shows a top view of the first embodiment of the immersion pump 1. The pump casing 3.1 shown comprises an outlet chamber which is fluidically connected to the pump chamber 3.1.1 and has at least two outlet openings 3.1.4 through which the fluid can be pumped out. The two outlet openings 3.1.4 make it possible to achieve more liter capacity by means of two commercially available hoses, typically with a DN between 2 and 5 inches, without having to resort to expensive and difficult-to-install hoses with larger diameters.

The adapters 4 shown, which can be connected to the outlet openings, allow the user to display different characteristic curves with a single immersion pump by selecting different adapters 4. In addition, the two outlet openings 3.1.4 also allow the user to display the characteristic curves twice. He can therefore choose, for example, to operate the immersion pump 1 with one outlet opening, for example 4 inches, or with two outlet openings, for example 2 times 2 inches, which would correspond to the use of two immersion pumps 1. In conjunction with an adjustable speed of the drive unit 2, this is both energy-efficient and without the risk of overloading the drive unit 2. In order to be able to change the adapters 4 quickly, the two stubs can each have an outlet flange to which the adapters 4 can be operatively connected.

Figure 3:
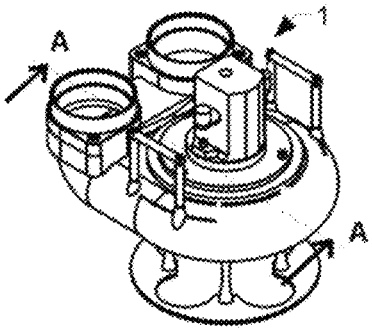
FIG. 3 shows a perspective view from the top onto the first embodiment of the immersion pump according to FIG. 1 with sectional view A-A.
Figure 4:
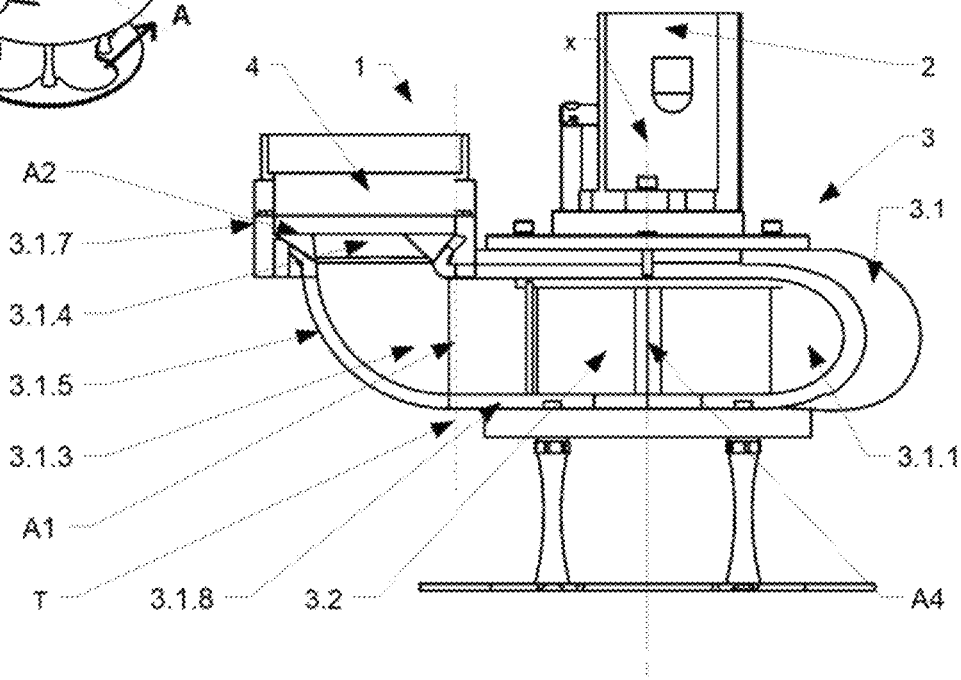
FIG. 4 shows the first sectional side view along A-A of the first embodiment of the immersion pump according to FIG. 3.

FIG. 3 shows a perspective view from the top onto the first embodiment of the immersion pump according to FIG. 1 with a sectional view along A-A. FIG. 4 shows a first sectional view of the first embodiment of the immersion pump 1 along A-A. The pump unit 3 shown comprises a pump impeller 3.2 in the pump casing 3.1. The pump impeller 3.2 is arranged to rotate within the pump casing 3.1 and draws in the fluid through at least one inlet opening (suction side) and discharges it again at increased pressure (pressure side). The pump casing 3.1 of the immersion pump 1 according to the disclosure has a pump chamber 3.1.1, in which the pump impeller 3.2 is arranged rotatably about the rotational axis x, and an outlet chamber 3.1.3 formed thereon.

In order to be able to pump coarser impurities in the fluid to be pumped, particularly in wastewater disposal, the free passage of the immersion pump 1 is typically generously dimensioned. In order to make the free passage as large as possible, the pump chamber 3.1.1 shown is therefore typically generously dimensioned in circumferential direction with respect to the pump impeller 3.2. The ratio of the diameter of the pump chamber 3.1.1 to the diameter of the pump impeller 3.2 is typically 3:1, preferably 2:1. The pump casing 3.1 has a casing wall 3.1.8, which runs around the pump impeller 3.2 and is curved in the circumferential direction of the pump impeller 3.2. In order to achieve a flow within the pump chamber 3.1.1 with as little turbulence as possible, the geometry of the pump casing 3.1 shown is selected in such a way that both narrow points are largely excluded and the flow does not encounter any vertical surfaces in the area of transitions.

The outlet chamber 3.1.3 shown is designed in such a way that the fluid between the pump chamber 3.1.1 and the two outlet openings 3.1.4 is essentially deflected by 90°, in the embodiment shown from the horizontal to the vertical direction. The two outlet openings 3.1.4 are arranged parallel to each other and/or parallel to the rotational axis x. The pump flow is diverted from the horizontal to the vertical direction via the bend shown. The cross-sectional area of the outlet is maintained over the entire area of the bend in order to avoid constriction.

Figure 5:
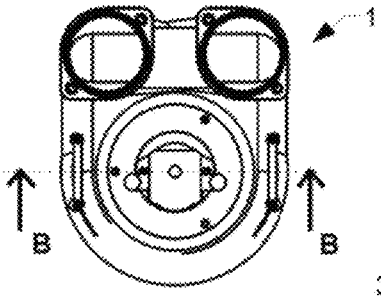
FIG. 5 shows a top view onto the first embodiment of the immersion pump according to FIG. 1 with sectional view B-B.
Figure 6:
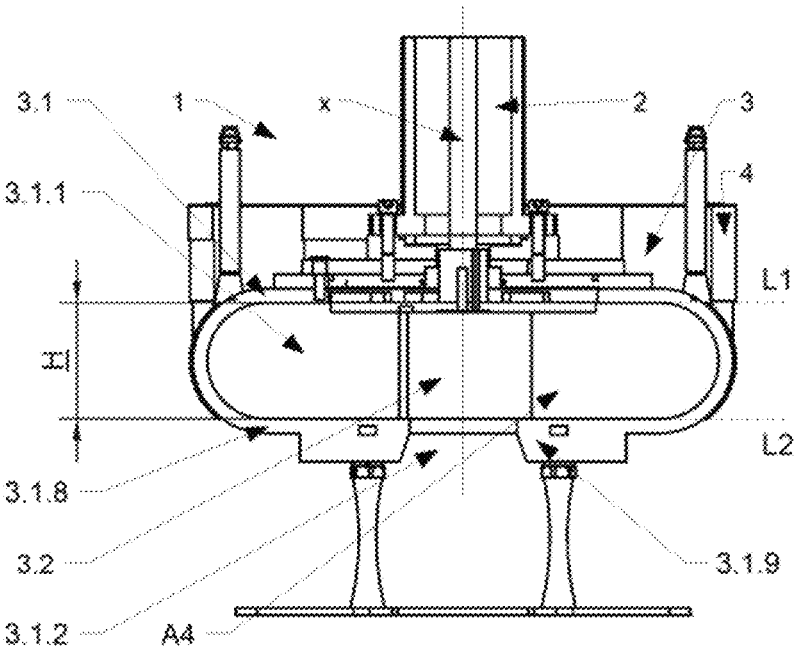
FIG. 6 shows the second sectional side view along B-B of the first embodiment of the immersion pump according to FIG. 5.

FIG. 5 shows a top view onto the first embodiment of the immersion pump according to FIG. 1 with sectional view B-B. FIG. 6 shows a second sectional view of the first embodiment of the immersion pump 1 along B-B. The pump chamber 3.1.1 has an inlet opening 3.1.2 for the fluid. The pump chamber 3.1.1 shown is limited by an upper level L1, which points towards the drive unit 2, and is limited on the opposite side by a lower level L2, which points away from the drive unit 2. The substantially cylindrical pump impeller 3.2 shown is arranged in the pump chamber 3.1.1, with the base and top surfaces of the pump impeller 3.2 being arranged parallel to the upper L1 and lower L2 levels of the pump chamber 3.1.1. The inlet opening 3.1.2 is arranged on the side of the pump casing 3.1 facing away from the drive unit 2 and is aligned collinearly to the rotational axis x. The inlet opening 3.1.2 is arranged in an inlet flange 3.1.9 of the pump casing 3.1. The inlet flange 3.1.9 is flow-optimized, preferably funnel-shaped.

Figure 7:
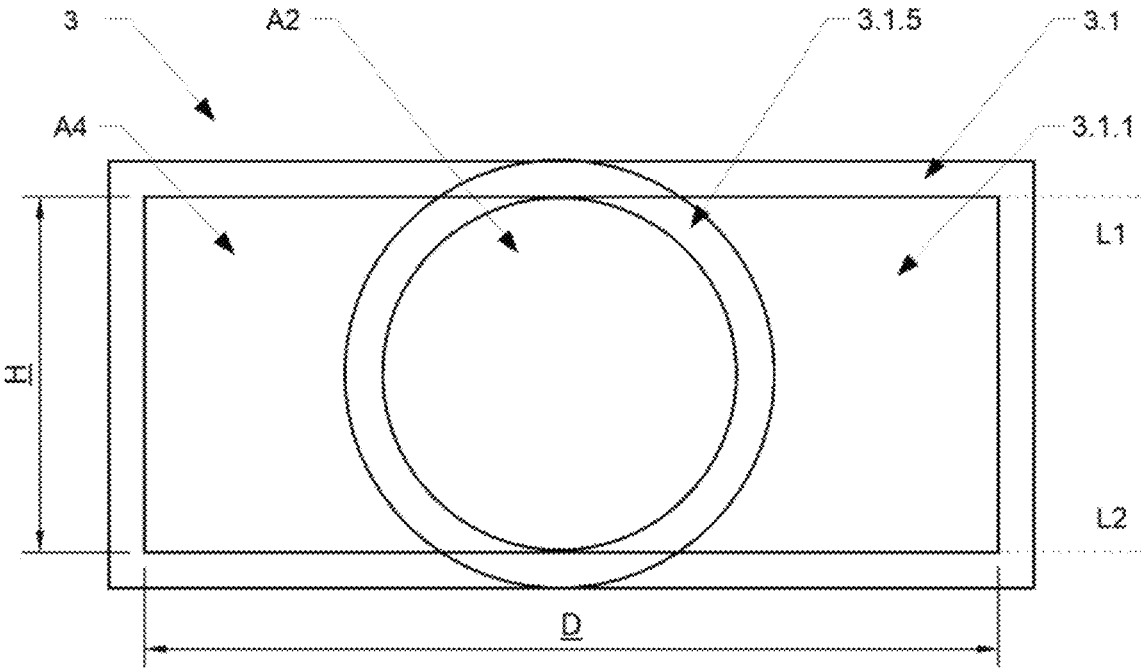
Prior art Fig. 7
FIG. 7 shows a typical design variant of the pump casing of the prior art.

FIG. 7 shows a typical embodiment of the pump casing 3.1 of the prior art. Conventional pump casings 3.1 usually have an essentially circular cylindrical cross-section on which an inlet flange and an outlet flange are formed. While the diameter D of the pump chamber can be increased to the diameter of the pump impeller 3.2 with a still tolerable loss of performance, an increase in the clearance height between the upper level L1 and the lower level L2 of the pump chamber 3.1.1 drastically reduces the pump performance. Therefore, when dimensioning the pumps, an attempt is made to keep the clearance height H of the pump chamber as low as possible in relation to the height of the pump impeller. However, this leads to problems when discharging the pumped fluid at the outlet side. In the cross-section shown, the fluid is discharged from the pump chamber 3.1.1 via a stub 3.1.5, which has a circular cylindrical cross-section. However, this cross-section is limited to a diameter that corresponds to the clearance height H of the casing. This transition between the pump chamber and the outlet typically limits the liter capacity of the pump to be pumped, as this smallest cross-section of the pump casing limits the flow rate.

Figure 8:
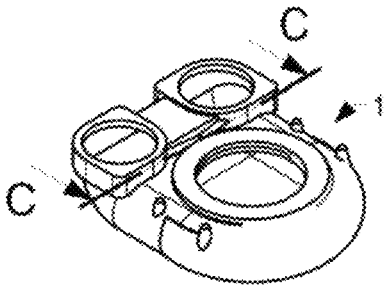
FIG. 8 shows a perspective view from the top onto the first embodiment of the immersion pump according to FIG. 1 with sectional view C-C.
Figure 9:
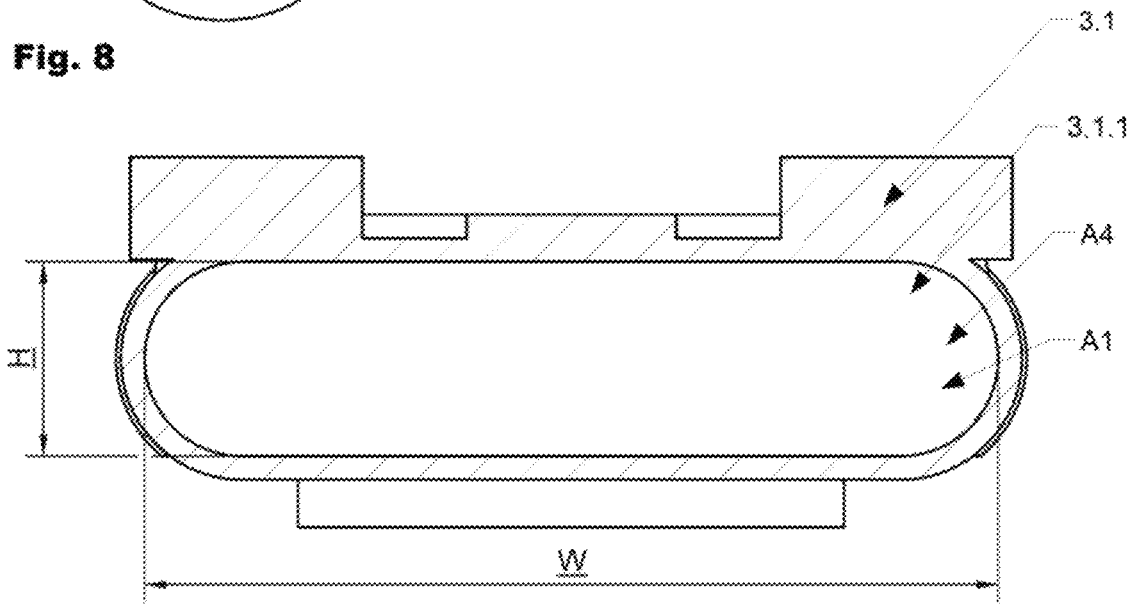
FIG. 9 shows the first sectional side view along C-C of the first embodiment of the pump casing according to FIG. 8.

FIG. 8 shows a perspective view from the top onto the first embodiment of the immersion pump according to FIG. 1 with sectional view C-C. FIG. 9 shows a first sectional view of the first embodiment of the pump casing 3.1 along C-C. The cross-sectional area of the outlet chamber between the first functional cross-sectional area and the second functional cross-sectional area is consistently at least as large or larger than the second functional cross-sectional area. The same also applies in the transition between pump chamber 3.1.1 and outlet chamber. The first functional cross-sectional area A1 is equal to the functional cross-sectional area of the pump chamber A4 in the area of the rotational axis. The cross-sectional area of the pump chamber 3.1.1 results from an imaginary section of the pump casing 3.1 along the rotational axis, with the sectional area being selected parallel to the transition between the pump chamber and the outlet chamber. The cross-section of the transition between the pump chamber and outlet chamber extends over the entire clearance height H of the pump casing and over the entire width W of the pump casing.

Figure 10:
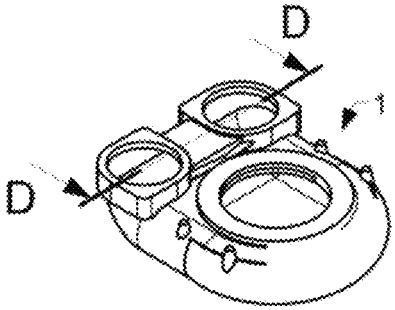
FIG. 10 shows a perspective view from the top onto the first embodiment of the immersion pump according to FIG. 1 with sectional view D-D.
Figure 11:
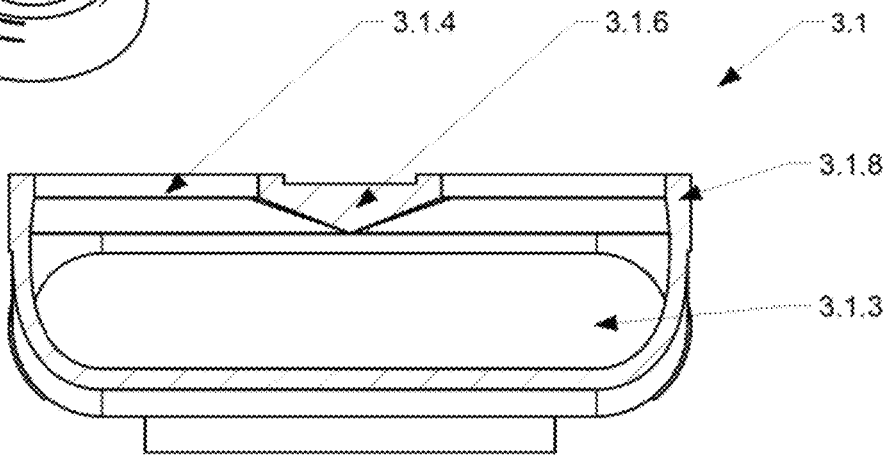
FIG. 11 shows the sectional side view along D-D of the first embodiment of the pump casing according to FIG. 10.

FIG. 10 shows a perspective view from the top onto the first embodiment of the immersion pump according to FIG. 1 with sectional view D-D. FIG. 11 shows a second sectional view of the first embodiment of the pump casing 3.1 along D-D. The outlet chamber has an essentially oval cross-section on the inlet side, preferably at the transition between the pump chamber and the outlet chamber, and merges into two stubs on the outlet side. Each of the stubs typically merges into one of the two outlet openings 3.1.4. In order to distribute the fluid pumped by the pump impeller between the two stubs in the outlet chamber 3.1.3, a protrusion 3.1.6 is arranged in the outlet chamber 3.1.3, preferably between the two stubs. The protrusion 3.1.6 shown serves as a guide element, which divides the fluid sucked or drawn in by the pump impeller between the two stubs and is preferably V-shaped. The shape of the stubs is typically adapted from an oval inlet to a round outlet in a flow-optimized manner via inclined surfaces.

Figure 12:
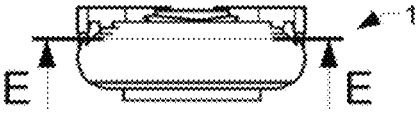
FIG. 12 shows a side view onto the first embodiment of the immersion pump according to FIG. 1 with sectional view E-E.
Figure 13:
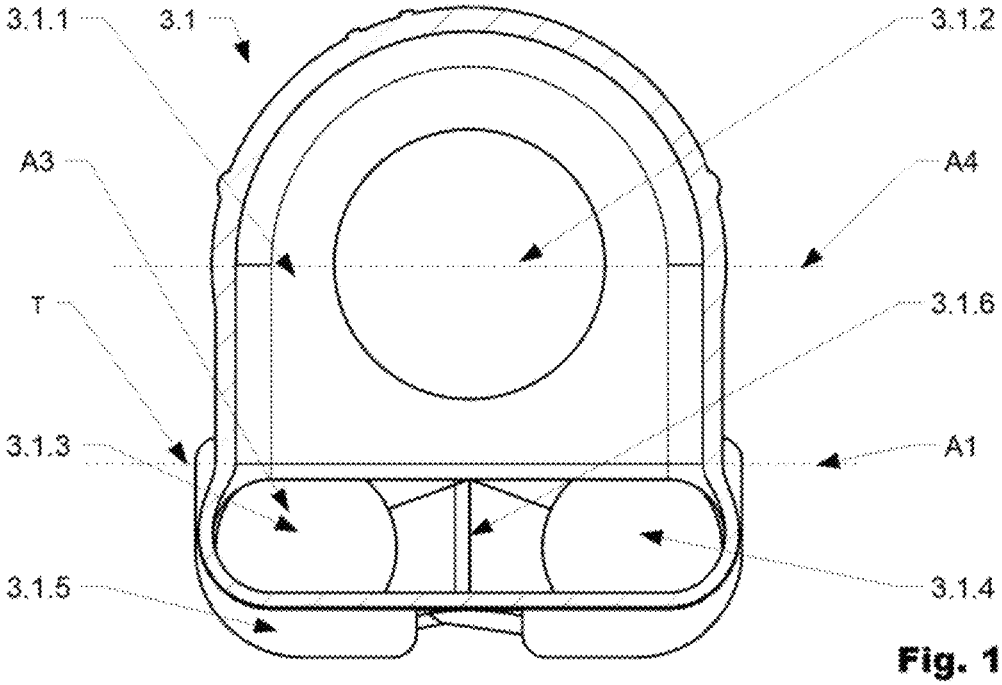
FIG. 13 shows the sectional top view along E-E of the first embodiment of the pump casing according to FIG. 12.

FIG. 12 shows a side view onto the first embodiment of the immersion pump according to FIG. 1 with sectional view E-E. FIG. 13 shows a third sectional view of the first embodiment of the pump casing 3.1 along E-E. In order to achieve a continuous cross-sectional area between the pump chamber 3.1.1 and the two outlet openings 3.1.4, the pump chamber 3.1.1 has a U-shaped cross-section in a top view along the rotational axis. The outlet chamber 3.1.3 has an oval cross-section when viewed from the top. The outlet chamber 3.1.3 has a first functional cross-sectional area A1 on the inlet side at the transition T to the pump chamber 3.1.1 and a second functional cross-sectional area on the outlet side, which is formed by the two outlet openings 3.1.4. In order to avoid a reduction in the cross-section between the transition T between pump chamber 3.1.1 and outlet chamber 3.1.3 and thus a reduction in the liter capacity of the entire pump, the outlet chamber 3.1.3 is flow-optimized.

Between the inlet side of outlet chamber 3.1.3 and the outlet side of outlet chamber 3.1.3, there is both a widening of the flow channel and a corresponding reduction. The target cross-section is decisive for the dimensioning of outlet chamber 3.1.3. This is specified by the standardized hoses and their adapters. The target cross-section is typically the functional cross-section of the outlet point, hence the functional cross-sectional area of the outlet openings. The outlet chamber 3.1.3 is designed in such a way that, although the cross-sectional area changes over the entire flow channel between the first functional cross-sectional area A1 and the second functional cross-sectional area over the entire length of the flow channel, its functional cross-sectional area A3 is at least equal to that of the target cross-section and does not fall below it.

The invention claimed is:

1. An immersion pump (1) for pumping at least one of a fluid, industrial water and waste water, the immersion pump (1) comprising:

a. a drive unit (2) which extends along a rotational axis (x) and which is connected to a pump unit (3), wherein b. the pump unit (3) comprises a pump casing (3.1) and a pump impeller (3.2), wherein the pump casing (3.1) comprises i. a pump chamber (3.1.1) in which the pump impeller (3.2) is arranged rotatably about the rotational axis (x) and comprises at least one inlet opening (3.1.2) for the fluid, and ii. an outlet chamber (3.1.3) which is fluidically connected to the pump chamber (3.1.1) and comprises two outlet openings (3.1.4) configured for pumping out of the fluid, wherein the outlet chamber (3.1.3) includes a substantially oval cross-section on the inlet side, having a height (H) and a longer width (W), and merges into two stubs (3.1.5) on the outlet side, wherein each of the stubs (3.1.5) merges into one of the two outlet openings (3.1.4).

2. The immersion pump (1) according to claim 1, wherein the outlet chamber (3.1.3) includes a first functional cross-sectional area (A1) on the inlet side at the transition (T) to the pump chamber (3.1.1) and a second functional cross-sectional area (A2) on the outlet side which is formed by the two outlet openings (3.1.4).

3. The immersion pump (1) according to claim 2, wherein the outlet chamber (3.1.3) between the first functional cross-sectional area (A1) and the second functional cross-sectional area (A2) includes a constant cross-sectional area (A3) which is at least as large or larger than the second functional cross-sectional area (A2).

4. The immersion pump (1) according to claim 2, wherein the pump chamber (3.1.1) includes a functional cross-sectional area (A4) in the region of the rotational axis (x) and the first functional cross-sectional area (A1) corresponds to the functional cross-sectional area (A4) of the pump chamber (3.1.1).

5. The immersion pump (1) according to claim 1, wherein the outlet chamber (3.1.3) deflects the fluid between the pump chamber (3.1.1) and the two outlet openings (3.1.4) by 90°.

6. The immersion pump (1) according to claim 1, wherein a protrusion (3.1.6) is arranged between the two stubs (3.1.5) in the outlet chamber (3.1.3), which protrusion acts as a guide element in order to divide the fluid drawn in by the pump impeller (3.2) between the two stubs (3.1.5).

7. The immersion pump (1) according to claim 6, wherein the protrusion (3.1.6) is V-shaped.

8. The immersion pump (1) according to claim 6, wherein the two stubs (3.1.5) each have an outlet flange (3.1.7) configured to receive adapters (4) for operatively connecting different hose diameters.

9. The immersion pump (1) according to claim 1, wherein the pump chamber (3.1.1) includes at least one of a U-shaped cross-section in a top view along the rotational axis (x) and the outlet chamber (3.1.3) includes an oval cross-section in a top view.

10. The immersion pump (1) according to claim 1, wherein the two outlet openings (3.1.4) are arranged parallel to each other and/or parallel to the rotational axis (x).

11. The immersion pump (1) according to claim 1, wherein the pump casing (3.1) includes a casing wall (3.1.8) which encompasses the pump impeller (3.2) and is curved in the circumferential direction of the pump impeller (3.2).

12. The immersion pump (1) according to claim 1, wherein the inlet opening (3.1.2) is arranged on a side of the pump casing (3.1) facing away from the drive unit (2), collinear to the rotational axis (x).

13. The immersion pump (1) according to claim 1, wherein the inlet opening (3.1.2) is arranged in an inlet flange (3.1.9) of the pump casing (3.1), which inlet flange (3.1.9) is shaped like a funnel.

14. The immersion pump (1) according to claim 1, wherein the drive unit (2) is an electric motor or is a hydraulic drive unit.

15. The immersion pump (1) according to claim 1, wherein the outlet chamber (3.1.3) deflects the fluid between the pump chamber (3.1.1) and the two outlet openings (3.1.4) from a horizontal direction to a vertical direction.

* * * * *